340-565 SR
8/18/87 XR 4,688,025

United States Patent [19]

Frank

[11] Patent Number: 4,688,025

[45] Date of Patent: Aug. 18, 1987

[54] MOVEMENT SENSOR

[75] Inventor: Peter Frank, London, England

[73] Assignee: Product Innovation Limited, London, England

[21] Appl. No.: 668,260

[22] Filed: Nov. 5, 1984

[30] Foreign Application Priority Data

Nov. 4, 1983 [GB] United Kingdom ..... 8329532
Sep. 10, 1984 [GB] United Kingdom ..... 8422802

[51] Int. Cl.[4] ..... G08B 13/14

[52] U.S. Cl. ..... 340/571; 340/566; 340/689; 200/61.45 R

[58] Field of Search ..... 340/571, 689, 687, 566, 340/669, 571; 200/61.45 R, 61.52

[56] References Cited

U.S. PATENT DOCUMENTS 3,742,478 6/1973 Johnson ..... 200/61.45 R X
3,962,696 6/1976 Smith et al. ..... 340/566
3,999,178 12/1976 Hamilton ..... 340/689 X
4,196,429 4/1980 Davis ..... 340/571 X
4,484,186 11/1984 Wood et al. ..... 340/689

FOREIGN PATENT DOCUMENTS 0098913 4/1984 European Pat. Of. .

*Primary Examiner*—Glen R. Swann, III
*Assistant Examiner*—Jeffery A. Hofsass
*Attorney, Agent, or Firm*—Thomas A. O'Rourke

[57] ABSTRACT

A movement sensor having a movable part, detection means for providing a first detection signal when the part is in one position and a second detection signal when the part is in a different position, and means for producing an alarm signal in response to the first and second detection signals being successively provided after initiation of the operation of the sensor irrespective of the order in which said signals are provided.

13 Claims, 6 Drawing Figures

MOVEMENT SENSOR

This invention relates to a movement sensor, and particularly, but not exclusively, to a movement sensor suitable for installation in a valuables box.

Most commonly known jewellery boxes and cash boxes are lockable but are small enough to be easily portable and can therefore be carried away, for example by a house burglar who can then empty the contents at leisure. It has therefore been proposed to provide a box having a movement sensor operable to actuate an alarm when the box is moved. This has the advantage that a potential thief can neither attempt to open the box nor carry the box away without setting off the alarm and hence being discovered.

However, the provision of a suitable movement sensor for such a box has proved difficult. The sensor should be inexpensive, reliable and sensitive. It should not be easily damaged by, for example, dropping the box. It would also be desirable for the sensor to be capable of operating correctly irrespective, to a large extent, of the precise orientation of the sensor. This latter feature is desirable to allow for situations in which the box is not located on a precisely horizontal surface, and conflicts to a certain extent with the requirement for good sensitivity. It is also desirable that the operation of the sensor should not rely on the movement taking place in a specific direction, in which case operation of the sensor could be avoided by careful handling.

U.S. Pat. Nos. 3,742,478 and 4,196,429 describe a number of motion sensors in which an electrically conductive ball is confined for movement within a generally cylindrical container. On an inner surface of the container (either on the cylindrical side wall or on one or both of the end walls), two sets of elongate contacts are formed, the contacts of each set being interdigitated with those of the other set. The ball is able to bridge an adjacent pair of contact so as to form an electrical connection between the two sets. As the device is moved, the ball rolls over the contacts, thus successively making and breaking connections between the two sets. This is detected by a circuit coupled to the contacts, and an alarm is then sounded.

A problem with these arrangements is that the alarm may sound in response to a slight vibration, resulting in the ball successively making and breaking the same contact, without there being any bodily movement of the device. To avoid this, one of the arrangements described in U.S. Pat. No. 3,742,478 has a third set of contacts which are interdigitated with the first and second sets. The alarm is sounded only after the ball first makes contact between the first and second sets of contacts, and subsequently makes contact between the second and third sets. This requires a complicated arrangement of electrodes and also means that the sensitivity of the device is dependent upon the initial position of the ball prior to movement of the device.

A further, significant disadvantage of the arrangements of U.S. Pat. No. 3,742,478 and U.S. Pat. No. 4,196,429 is that they rely upon the ball bridging adjacent contacts which thus have to stand proud of the surface over which the ball rolls. The movement of the ball is therefore, unavoidably, impeded and consequently the sensitivity of the device is substantially reduced. In addition, the elevated contacts produce a tendency for the ball to run along between contacts rather than ride over the upper surfaces thereof, which would prevent the alarm from sounding. It is proposed in each of the patents to arrange the contacts such that this tendency is reduced; however, this does not entirely solve the problem and results in a complicated electrode pattern.

According to a broad aspect of the present invention a movement sensor has a movable part, and means for generating an alarm signal in response to detecting that said part has moved between different positions.

In the preferred embodiment, a first detection signal is provided when the part is in one position, and a second signal when the part is in a different position. The alarm signal is generated when the first and second signals have both been provided.

Preferably, the alarm signal is produced only if both detection signals have been provided within a predetermined interval, and preferably irrespective of which of these signals occurred first so that the alarm signal is given whichever direction the part has moved in.

The inertia of the part will initially tend to move it in a first direction as the sensor is accelerated away from its position of rest. One embodiment of the invention relies on the fact that, in practice, it is impossible for the sensor to continue to accelerate in the same direction, and the arrangement is such that eventually the deceleration causes, or allows, the part to move in the other direction. In such an arrangement, it does not matter whether, when the sensor is stationary, the part is located in its first position, in its second position or in an intermediate location. In any event, on movement of the sensor, the part will move to one of its positions, if it is not already at that position, and will thereafter move to the other position, whereby the alarm signal is generated.

Other embodiments of the invention are arranged so as to detect when the part is in any of a plurality of "first" positions, and any of a plurality of "second" positions which are intermediate the first positions. After the sensor is moved from its position of rest, the continued movement of the part will cause it to pass through either a first position followed by a second position, or a second position followed by a first position, and the alarm signal is then generated.

It will be appreciated that, in contrast to the arrangements of U.S. Pat. Nos. 3,742,478 and 4,196,429, by making the sensor respond to movement of the part between two separate positions, irrespective of the direction of movement, the sensor can be constructed so that it operates reliably irrespective of the initial position of the part, or of the sensor as a whole. This means that the sensor does not need to be positioned accurately for it to operate correctly and also means that it is less subject to damage because it does not rely upon the precise alignment or positional relationship between two relatively-movable components. The arrangement also has the advantage that precise adjustment of the sensor at the manufacturing state is unnecessary.

The part is preferably mounted in such a manner that it is free to move in opposite directions, to ensure that the sensor operates correctly. For this reason, it should be ensured that the part is not located in a position of unstable equilibrium.

By arranging for the alarm signal to be produced only if both detection signals have been provided within a predetermined interval, it is possible to avoid erroneous operation of the alarm due to a very slow, drifting movement of the movable part following the arming of the sensor. This is very important when the sensor is so designed that the part can move very easily and consequently good sensitivity is achieved. In these circumstances, after the sensor itself is left at rest, there is a strong likelihood of the part continuing to move for an extended period. Such an arrangement also provides a means of controlling the sensitivity of the sensor.

According to a further independent aspect of the invention, which is preferably combined with one or both of the above-mentioned specific aspects, there is provided a movement sensor comprising a ball, and a structure for confining the movement of the ball, the structure comprising a first wall carrying first and second electrical contacts and a second wall carrying terminal means, the ball being capable, during movement within the structure, of successively, electrically connecting the first and second contacts with said terminal means, the sensor further including a circuit for producing an alarm signal in response to detecting said successive connections.

The movable part may be a ball, and in the preferred embodiment the ball is conductive and is arranged to form an electrical connection with a first contact when the ball is in one position, and with a second contact when the ball is in a different position. The ball is preferably confined for movement, within a cylindrical container. There may be a plurality of first and second contacts on the first wall, which may be an end wall, but is preferably a cylindrical side wall. The use of a ball as the movable part makes it easier for the sensor to operate in all orientations, or in a very large range of orientations, and makes it easier for the part to be capable of moving in opposite directions.

However, a number of alternative arrangements are possible.

The part may be a member mounted for pivotal or rotational movement, and the first and second positions reached by movement of the member respectively in anticlockwise and clockwise directions.

The member may be pivoted about an axis for movement in a fixed plane, or alternatively may be pivoted about a pivot point so that movement is not confined to one plane. In either case, it is preferred that the member be in stable or substantially neutral equilibrium so that movement in opposite directions is not restricted, and for this reason the centre of gravity of the member is preferably on or below the pivot point or pivot axis.

The sensor may be arranged such that, after the initial movement of the part caused by the acceleration of the sensor from its position of rest, the movement of the part in the opposite direction caused by deceleration of the sensor is assisted. This could be achieved by locating the part in a state of stable equilibrium, as suggested above, or by providing some sort of biasing means to attain stable equilibrium, and/or by causing the part, on reaching each position, to bounce away from that position (e.g. by providing a resilient stop).

Although the sensor may be able to operate reliably in any of a number of different orientations, there may be a limit to the range of orientations within which the sensor will work, and for this reason the sensor may additionally have means for detecting when the sensor is positioned outside the range of orientations within which it will work reliably. This may also cause the alarm signal to be generated.

As indicated above, the movement sensor of the invention is of particular value when used in a valuables box, and the invention extends to a valuables box including such a movement sensor. However, the invention also has value in other fields. In addition, the movement sensor could be sold as a unit having means for attachment to items of value, to prevent theft of the items.

Arrangements embodying the invention will now be described by way of example with reference to the accompanying drawings, in which.

Figure 1:
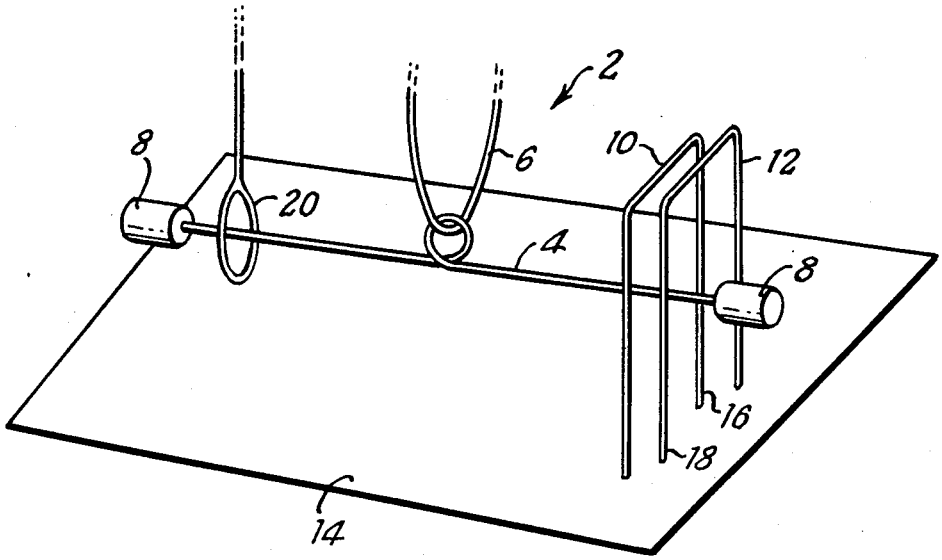
FIG. 1 is a perspective view of a movment sensor in accordance with the invention.

Referring to FIG. 1, the movement sensor 2 comprises a movable part 4 in the form of a member which can pivot with respect to the rest of the sensor. The part 4 comprises a wire which is looped in the middle around a support wire 6 which is itself supported from above by a suitable structure (not shown). The point of engagement between the wires acts as a pivot point. The part 4 also has a pair of weights 8, located one at each end of the wire, so as to increase its inertia.

The sensor 2 also has two frames 10 and 12 fixed to and extending upwardly from a base 14. The part 4 extends between uprights 16 and 18 of the frames 10 and 12 respectively.

The other end of the part 4 extends through a wire loop 20 supported from above.

The loop 20, uprights 16 and 18 and part 4 are connected (in the case of part 4 via the wire 6) to respective parts of the sensor's circuit.

The part 4 is balanced so that it is free to swing in a vertical plane, a horizontal plane, or in any intermediate plane.

As will be explained further, the sensor is arranged so that if the part 4 touches both of the uprights 16 and 18 within a predetermined interval, an alarm signal is given. An alarm signal is also given if the part 4 touches the ring 20.

When considering horizontal motion, the part 4 is in substantially neutral equilibrium. When at rest, the part 4 may therefore take up any position between the uprights 16 and 18, and indeed may be touching one of these uprights.

The centre of gravity of the part 4 is located directly beneath the point of engagement with the wire 6, and therefore when considering movement in a vertical plane, the part 4 substantially in stable equilibrium.

Upon movement of the sensor 2, the inertia of the part 4 will cause the part to move relative to the rest of the sensor. Because of the way the part 4 is supported, it would be virtually impossible to move the sensor 2 without imparting some horizontal component of movement to the part 4. The part 4 will therefore come into engagement with one of the uprights 16 and 18, if it is not already in contact with that upright.

As the sensor 2 slows down, or changes its direction of movement, the inertia of the part 4 will then cause it to move toward the opposite upright. This movement is aided to a certain extent by the resiliency of the part 4 and the uprights 16 and 18, which produces a "bouncing" effect. Thus, both uprights 16 and 18 will be contacted within a short interval, and the alarm signal will be generated.

Fairly substantial variations in the initial orientation of the sensor 2 will have little if any effect upon the operation of the sensor. For example, turning the sensor 2 about a horizontal axis perpendicular to the part 4 will, so long as the reorientation is not excessive, merely change the vertical position of the arm 4 relative to the uprights 16 and 18. Turning the sensor 2 about an axix parallel to the part 4 may cause the part 4 to come into contact with one of the uprights 16 and 18, but as indicated above this will not significantly affect operation, so long as the re-orientation is not excessive.

However, if the sensor 2 is re-oriented by a very large amount, the part 4 will no longer be able to move freely between the uprights 16 and 18. For example, if the sensor 2 were to be turned upside down, the centre of gravity of the part 4 will no longer be beneath the pivot point, and the part 4 would therefore be in unstable equilibrium. The part would therefore come into rest in a position from which it could be displaced only by vigorous movement of the sensor.

To avoid such problems, the ring 20, which acts as a limit detector, is provided. If the sensor 2 is reorientated by a large amount, the arm 4 is no longer balanced properly and therefore the end extending through the ring 20 will come into engagement with the ring and cause the alarm signal to be generated. Thus, a user will not inadvertently leave the sensor 2 in an orientation in which it cannot operate correctly.

Figure 2:
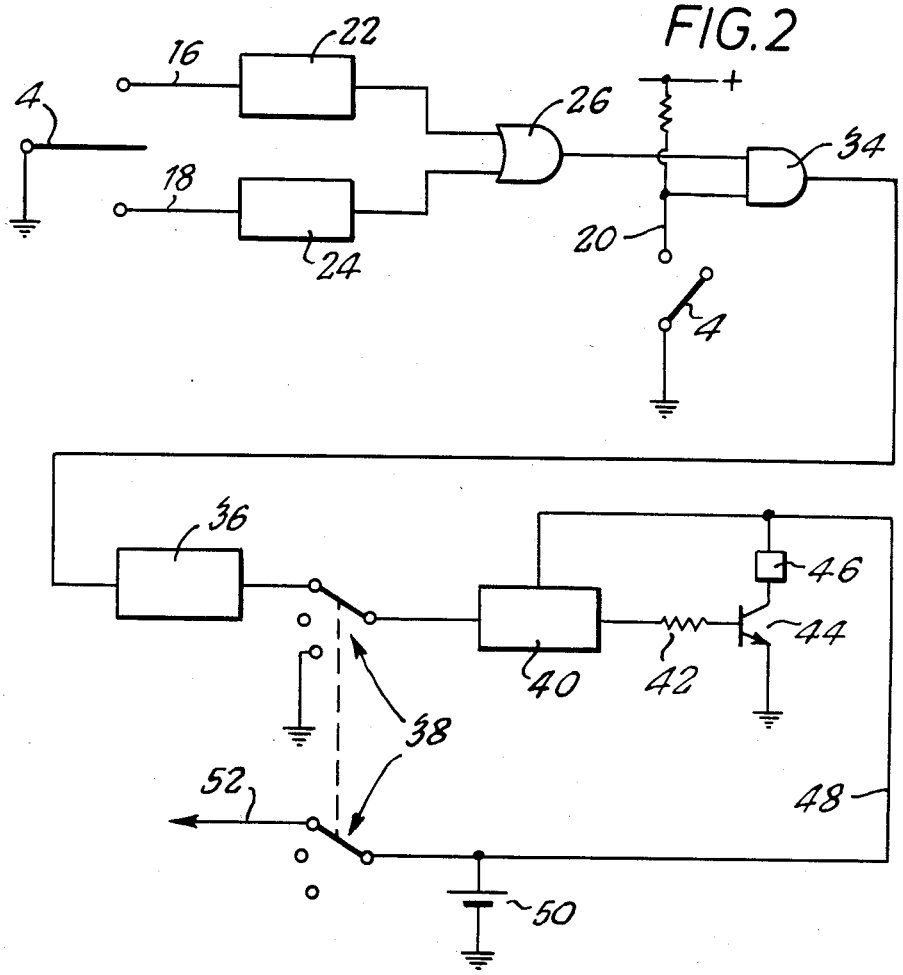
FIG. 2 is a schematic circuit diagram of the movement sensor of FIG. 1.

The circuit of the movement sensor 2 is shown in FIG. 2, in which parts corresponding to those shown in FIG. 1 are denoted by like numerals.

The part 4 is connected to ground potential. The uprights 16 and 18 are connected to inputs of respective delay circuits 22 and 24, the outputs of which are connected to respective inputs of an OR gate 26.

The inputs and outputs of the delay circuits 22 and 24 and of the OR gate 26 are normally at a high voltage level. The delay circuits 22 and 24 are each arranged so that, as soon as its input goes low, its output also goes low. However, when the input goes high, there is a predetermined delay before the output goes high.

Figure 3:
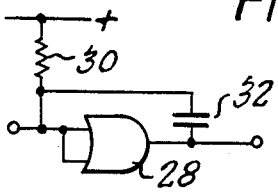
FIG. 3 shows a delay circuit which can be used in the circuit of FIG. 2.

A suitable delay circuit is shown in FIG. 3. This comprises an OR gate 28 having both its inputs normally held high by a resistor 30. A capacitor 32 is connected between its output and its inputs.

If the inputs are shorted to ground, the output voltage immediately goes low. If the short is then removed, the input voltage will rise gradually as the capacitor 32 is charged via the resistor 30, so that there will be a delay before the output goes high.

Referring again to FIG. 2, it will be appreciated that the output of one of the delay circuits 22 and 24 will go low as soon as the part 4 touches the appropriate one of the uprights 16 and 18. If the part 4 then leaves that upright and contacts the other upright within the predetermined delay time, both the outputs of the delay circuits 22 and 24 will be low simultaneously, so that the output of the OR gate 26 will go low. As will be explained, this will cause generation of an alarm signal.

The delay of the circuits 22 and 24 is selected to be long enough so that the sensor is not erroneously activated because of very slow, drifting movement of the part 4, for example after the sensor has been positioned and switched on, and short enough so that the sensor is not too insensitive. A suitable delay time is about half a second.

The output of the OR gate 26 is delivered to an input of an AND gate 34, having another input connected to the ring 20. Accordingly, the output of the AND gate 34 will go low either when the part 4 contacts both the uprights 16 and 18 within the predetermined delay time, or when the part 4 contacts the ring 20.

The output of the AND gate 34 is delivered to the input of a further delay circuit 36, the output of which constitutes the alarm signal. The delay circuit 36 is used to ensure that the alarm signal is generated at least for a predetermined minimum duration, e.g. of about twenty seconds.

The output of the delay circuit 36 is delivered via a contact of a switch 38 to an alarm generator 40. The alarm generator 40 is a standard integrated circuit available from Motorola under the part number 14466, for use in smoke-detector alarms. The output of the generator 40 drives, via a resistor 42 and transistor 44, and audio transducer 46 to generate a loud alarm sound.

The alarm generator 40 and audible transducer 46 receive power via a supply line 48 coupled directly to a battery 50. These parts of the circuit are permanently energised. The current drain is normally very small, and in fact tends to extend the life of the battery. In addition, this arrangement permits the circuit 40 regularly to check the battery level, and if it is found to have dropped significantly, the transducer 46 is caused to emit a distinctive sound so as to warn the user.

With the switch 38 positioned as shown in FIG. 2, the remaining parts of the circuitry receive power via a supply line 52. These parts of the circuitry can be switched off by turning the switch 38 to the centre contacts. In addition, the apparatus can be put in a test mode by turning the switch 38 to the lowermost contacts, which causes the input to the audible generator 40 to be grounded and thus produces an alarm.

Figure 4:
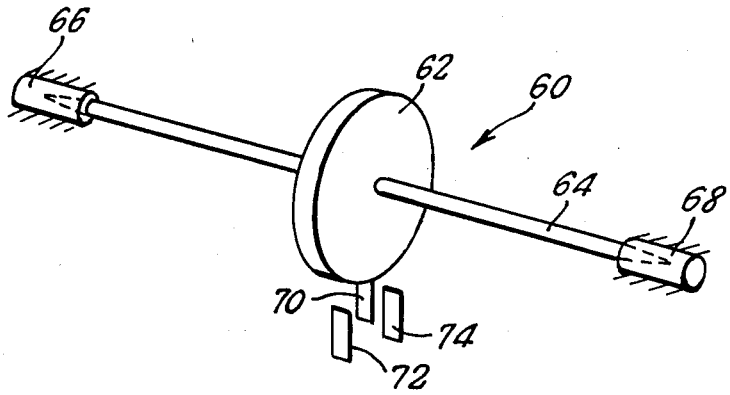
FIG. 4 is a perspective view of a different embodiment of a movement sensor.

FIG. 4 shows another embodiment of a movement sensor according to the invention. The sensor 60 shown here comprises a flywheel 62 having a central shaft 64 which is supported by bearings 66 and 68 for rotation about its axis. The flywheel 62 carries an electrical contact 70 positioned between two spaced-apart contacts 72 and 74.

The sensor 60 also has a circuit substantially as shown in FIG. 2. The flywheel 62 and attached electrical contact 70, and the contacts 72 and 74, correspond to the part 4 and the uprights 16 and 18 of the circuit of FIG. 2. It will be appreciated that due to the large inertia of the flywheel 62 movement of the sensor will tend to cause rotation so that the contact 70 will engage one of the contacts 72 and 74, then any subsequent change in the movement of the sensor will cause the contact 70 to engage the other of the contacts 72 and 74. The sensor of FIG. 4 thus acts in a manner corresponding to that of the sensor of FIG. 1. In this case, however, the sensor 60 can operate in substantially any orientation, because the flywheel 62 remains in substantially neutral equilibrium, which makes the limit detector unnecessary. Consequently, and AND gate 34 can be omitted and the output of gate 26 delivered directly to circuit 36.

Figure 5:
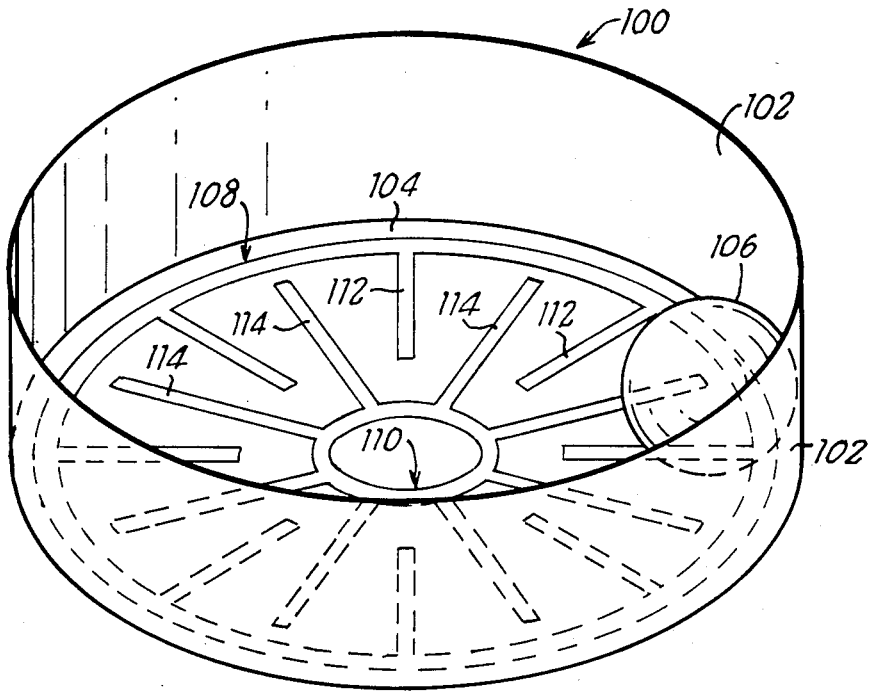
FIG. 5 is a perspective view of a further embodiment of a movement sensor.

FIG. 5 shows a further embodiment of the present invention. The movement sensor 100 of this embodiment comprises a cylindrical container formed of a circular cross-section side wall 102 and two end walls 104 only one of which is shown in FIG. 5 for the purposes of clarity. The closed container houses a ball 106 made of conductive material, and in this case formed by a metal ball-bearing. The ball 106 has a diameter slightly less than the height of the container.

The side wall 102 is made of conductive material, or alternatively has a conductive layer on its inner surface.

Each of the end walls 104 has on its inner surface electrically conductive regions 108 and 110. The region 108 has the shape of a ring with a plurality of radially inwardly extending contact arms 112. The region 110 is shaped as an inner ring having a plurality of radially outwardly extending contact arms 114 which are interdigitated with the arms 112. The regions 108 and 110 can be formed by any of the known methods for forming printed circuit boards, e.g. etching, or preferably by using printed conductive ink. It is important that the regions do not impede movement of the ball 106, and for this reason they are preferably substantially flush with the inner surface of the end wall 104.

In almost any orientation of the sensor 100, the ball 106 will rest with one part of its surface contacting the side wall 102, and another part touching either one of the arms 112, 114, or the space between a pair of such arms. Even if the ball 106 is not already in such a position, slight movement of the sensor 100 will cause it to adopt such a position. If desired, one or both end walls 104 and/or the side wall 102 can extend inwardly in its mid-region to encourage or guarantee the adoption of this position. Indeed, by inwardly doming the end walls 104 it is possible to arrange for the ball to be confined so that it can only run around the inner rim of the cylinder. Thereafter, movement of the sensor 100 will cause the ball to roll, while maintaining contact with the side wall 102, so that the ball 106 successively touches respective arms 112 and 114.

The sensor 100 operates in any plane. Whatever orientation the sensor 100 is in to begin with, the neutral equilibrium of the ball 106 and its tendency to roll within the container while maintaining two points of contact will ensure that the ball 106 electrically connects the side wall 102 with, successively, contact arms 112 and 114 formed on one or other of the end walls 104. If, for example, the sensor is moved while the end walls 104 are horizontal, the ball will tend to roll around the rim; if, as another example, the sensor is moved while the end walls 104 are vertical, the ball will tend to rock on the lowermost part of the inner surface of side wall 102.

Figure 6:
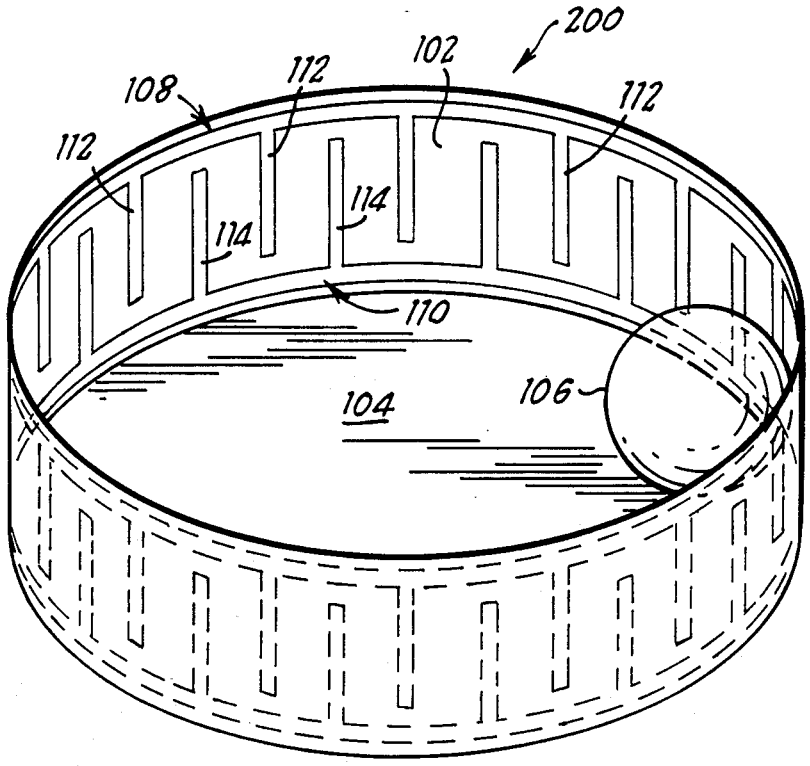
FIG. 6 is a perspective view of yet another embodiment of a movement sensor.

Referring to FIG. 6, the sensor 200 shown here is like that of FIG. 5 except that in this case the regions 108 and 110 are formed on the inner surface of the side wall 102, with the interdigitated contact arms 112 and 114 extending in the direction of the height of the cylindrical container. The inner surfaces of the end walls 104 are electrically conductive and electrically connected together. They form a common terminal which can be successively connected to arms 112 and 114 by the movement of the ball 106.

The arrangement of FIG. 6 has the advantage that, for a given minimum spacing between arms 112 and 114, a greater number of these amrs can be provided than in the arrangement of FIG. 5.

In both embodiments it is possible to form the conductive regions 108 and 110 on a substrate which is then attached to an inner surface of the cylindrical container.

The sensors 100 and 200 of FIGS. 5 and 6 each have a circuit identical to that used for the sensor 60 in FIG. 4, i.e. as shown in FIG. 2 except for the omission of the limit detector and consequently the AND gate 34. The ball 106 corresponds to the part 4, and the contact arms 112 and 114 to the uprights 16 and 18. In this case, however, the movable part, or ball 106, is connected to the ground terminal via its contact with the side wall 102 (in the case of FIG. 5) or an end wall 104 (in the case of FIG. 6), instead of being permanently connected to ground.

Any one of the sensors described above can be installed in a valuables box (not shown), so that the sensor can be armed using the switch 38, the valuables box closed and locked, and thereafter any movement of the box will cause the alarm to sound. If desired, there could be a delay between the operation of the switch 38 and the arming of the sensor to allow the user time to put the box away before the alarm goes off. There could if desired also be a delay between the sensing of movement and the activation of the alarm, so that when the owner wishes to open the box he will have time to switch off the alarm before the sound is generated.

The circuit is arranged so that once the alarm starts, the sound will continue for a predetermined period, e.g. twenty seconds, after the last detected movement of the box. Alternatively, the detection of movement could initiate the generation of sound for a predetermined delay period, and the circuit be arranged to continue to generate the alarm at the end of that period only if movement is detected at that time.

The circuit may incorporate a switch which is actuated by the opening and closing of a lid of the box so that the alarm is activated by the closing of the lid.

I claim:

1. A movement sensor comprising:

a movable part, said movable part being capable of adopting a first position and a second position, said first and second positions being spaced from each other;

detection means, said detection means providing a first detection signal when said movable part is in said first position and a second detection signal when said part is in said second position; and alarm signal generating means, said generating means being coupled to said detection means, said alarm signal generating means comprising timer means actuated by said first and second detection signals and defining a predetermined interval, whereby said alarm signal generating means generates an alarm signal (a) if said second detection signal is provided within said predetermined interval following generation of said first detection signal, or (b) if said first detection signal is provided within said predetermined interval following generation of said second detection signal.

2. A movement sensor according to claim 1, wherein the timer means includes a first delay circuit for providing a first detection output for a period equal to said predetermined interval following termination of said first detection signal, and a second delay circuit for providing a second detection output for a period equal to said predetermined interval following termination of said second detection signal, said alarm signal generating means being responsive to the simultaneous presence of both said first and second detection outputs for generating said alarm signal.

3. A movement sensor as claimed in claim 1, wherein said detection means comprises:

first and second spaced-apart electrical contacts; and a terminal, said terminal being electrically connectable to each of said first and second contacts by the movement of said part.

4. A movement sensor according to claim 3, wherein said detection means comprises a plurality of first contacts and a plurality of second contacts interdigitated with said first contacts.

5. A movement sensor according to claim 4, wherein the movable part is a ball for making electrical connection between said terminal and each of said first and second contacts.

6. A movement sensor according to claim 5, further comprising a substantially cylindrical structure within which said ball is confined, said structure having a first wall carrying said first and second contacts and a second wall carrying said terminal.

7. A movement sensor according to claim 6, wherein said first wall is a cylinder side wall and said second wall is a cylinder end wall.

8. A movement sensor comprising:

a movable part, said movable part being capable of adopting a first position and a second position, said first and second positions being spaced from each other;

detection means, said detection means providing a first detection signal when said movable part is in said first position and a second detection signal when said part is in said second position; and alarm signal generating means, said generating means being coupled to said detection means and being arranged to generate an alarm signal in response to (a) receipt of said first detection signal followed by said second detection signal, or (b) receipt of said second detection signal followed by said first detection signal.

9. A movement sensor comprising:

a movable part, said movable part being capable of adopting a first position and a second position, said first and second positions being spaced from each other;

detection means, said detection means providing a first detection signal when said movable part is in said first position and a second detection signal when said part is in said second position; and alarm signal generating means, said generating means being coupled to said detection means and comprising timer means actuated by one of said detection signals, whereby said alarm signal generating means is arranged to generate an alarm signal if said other detection signal is provided with in a predetermined interval following generation of said one detection signal.

10. A movement sensor comprising:

an electrically conductive ball;

a substantially cylindrical structure for confining the movement of said ball, said structure comprising a side wall and a first end wall;

first and second set of electrical contacts carried by said side wall, said contacts being spaced around the inner circumference of said structure with the contacts of said first set interdigitated with the contacts of said second set; and first terminal means carried by said end wall, said ball being capable, during movement within said structure, of successively, electrically connecting the contacts of said first and second set with said first terminal means; and an alarm signal generating circuit coupled to said contacts and said terminal means for producing an alarm signal in response to detecting said successive connections.

11. A movement sensor according to claim 10, wherein said first and second contacts have contact surfaces which are substantially flush with the inner surface of said side wall.

12. A movement sensor according to claim 10, further comprising a second end wall opposed to said first end wall, and second terminal means carried by said second end wall and connected to said first terminal means.

13. A movement sensor according to claim 10, wherein said alarm signal generating circuit includes timer means, whereby said alarm signal is provided only if successive connections are detected within a predetermined interval.

* * * * *